United States Patent [19]

Millman

[11] Patent Number: 4,711,982

[45] Date of Patent: Dec. 8, 1987

[54] PLASTIC MICROWAVE OVEN DOOR

[75] Inventor: Ronald W. Millman, Bloomington, Minn.

[73] Assignee: Litton Systems, Inc., Beverly Hills, Calif.

[21] Appl. No.: 869,212

[22] Filed: May 30, 1986

[51] Int. Cl.[4] ..... H05B 6/64

[52] U.S. Cl. ..... 219/10.55 D; 219/10.55 R; 219/10.55 F

[58] Field of Search ..... 219/10.55 D, 10.55 F, 219/10.55 M; 220/337, 338, 339; 427/99

[56] References Cited

U.S. PATENT DOCUMENTS

| | | | |
|---|---|---|---|
| 3,668,357 | 6/1972 | Kobayashi | 219/10.55 D |
| 3,843,859 | 10/1974 | Klemp et al. | 219/10.55 D |
| 3,978,249 | 8/1976 | Cooke | 427/99 |
| 4,015,085 | 3/1977 | Woods | 219/10.55 E |
| 4,053,731 | 10/1977 | Foerstner | 219/10.55 D |
| 4,385,082 | 5/1983 | Eichelberger et al. | 427/105 |
| 4,563,560 | 1/1986 | Bonner | 219/10.55 D |
| 4,609,800 | 9/1986 | Sakoda | 219/10.55 D |
| 4,645,892 | 2/1987 | Gustafsson | 219/10.55 D |

OTHER PUBLICATIONS

TAFA, Thick Zinc & Copper Zinc Coatings on Thin Plastic, 12/13/79.

*Primary Examiner*—A. D. Pellinen
*Assistant Examiner*—Leon K. Fuller
*Attorney, Agent, or Firm*—John M. Haurykiewicz; Walter R. Thiel

[57] ABSTRACT

A microwave oven door is disclosed having a channel cross-section and formed of plastic material having a microwave impermeable viewing window, hinge means, door securing means, and a microwave impermeable coating in the channel cross-section area. An alternative embodiment has the channel cross-section area formed of a plastic filled with a microwave blocking material. A further embodiment has a microwave impermeable opaque surface in place of the viewing window.

26 Claims, 14 Drawing Figures

PLASTIC MICROWAVE OVEN DOOR

BACKGROUND OF THE INVENTION

In the past, microwave oven doors have been assembled from a relatively large number of components including a number of plastic trim pieces, formed metal parts (generally in the shape of frames or pans), and various fasteners and additional metal parts such as a hinge pin brackets. The relatively large number of components was made necessary because of the number of different purposes that a microwave oven door must serve. First and foremost, the door must contain the microwave energy while the oven is operating. In addition, the door must be aesthetically pleasing, most often including the feature of a viewing window to permit visual inspection of the interior of the oven because of consumer demand for that feature. Great efforts have been expended on the design of microwave oven doors because of the importance of the door, both functionally and aesthetically. Nevertheless, until now, microwave oven doors have generally been relatively complicated and expensive to manufacture.

BRIEF SUMMARY OF THE INVENTION

This invention avoids the shortcomings of prior art microwave oven door assemblies by providing a microwave oven door structure having a unitary frame formed of plastic in a channel cross-section with hinge means and door securing means integrally formed on the frame. The escape of microwave energy is prevented by a microwave impermeable layer or coating on the interior of the frame channel or a filler material of microwave blocking material contained within the plastic cross-section channel of the frame. The region surrounded by the frame may contain a viewing window or may be an opaque surface and in either event will have means to prevent escape of microwave energy from the oven cavity.

DETAILED DESCRIPTION

Figure 1A:
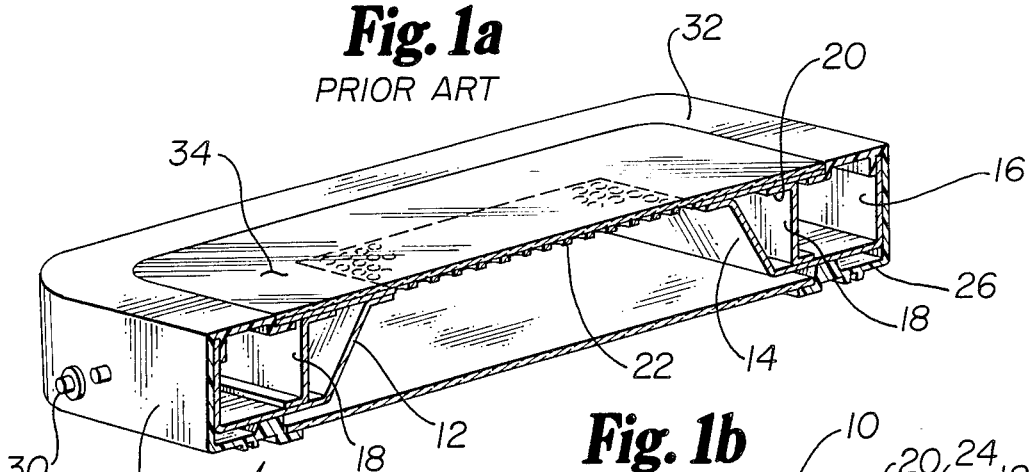
Fig. 1a PRIOR ART
FIGS. 1A and 1B show respectively, cutaway views of a perspective and edge-on view of a prior art microwave oven door assembly.
Figure 1B:
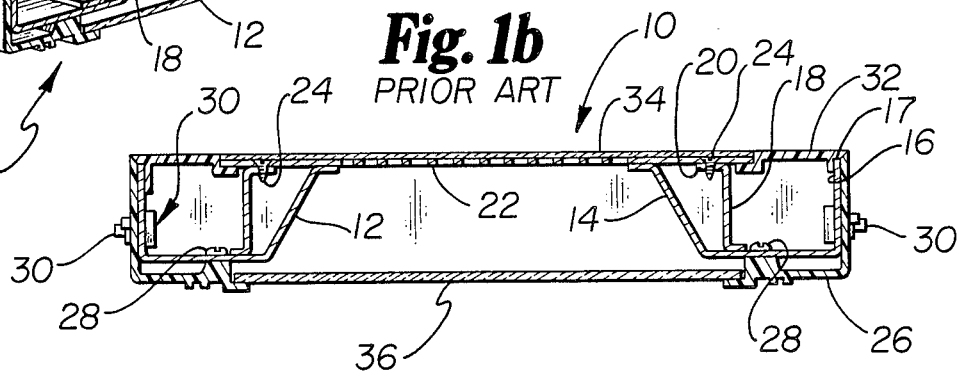
Fig. 1b PRIOR ART

Referring to FIG. 1A and 1B a prior art microwave oven door assembly 10 is shown. This assembly is built up of an interior pan-shaped, sheet metal frame 12, stamped to provide an inner beveled surface 14 and an outer perpendicular surface 16. In addition, an additional frame 18, also of sheet metal, was welded to frame 12 to provide a supporting flange 20. Supporting flange 10 carried a perforated sheet metal plate 22 which was secured to it by screws 24. Frame 12 was secured to an outer decorative housing 26 by means of screws 28. Frame 12 also carried hinge pin brackets 30 which extended through apertures in outer decorative housing 26. An inner door cover 32 was retained between the perforated sheet metal plate 22 and an edge 17 of the outer perpendicular surface 16 of frame 12. A decorative plastic sheet 34 was adhered to plate 22 for appearance sake, and an exterior clear plastic window 36 was retained by and secured to outer housing 26. It is to be understood that the surface of sheet 34 is the side of the door to be mounted adjacent the front surface of a microwave oven.

Figure 4:
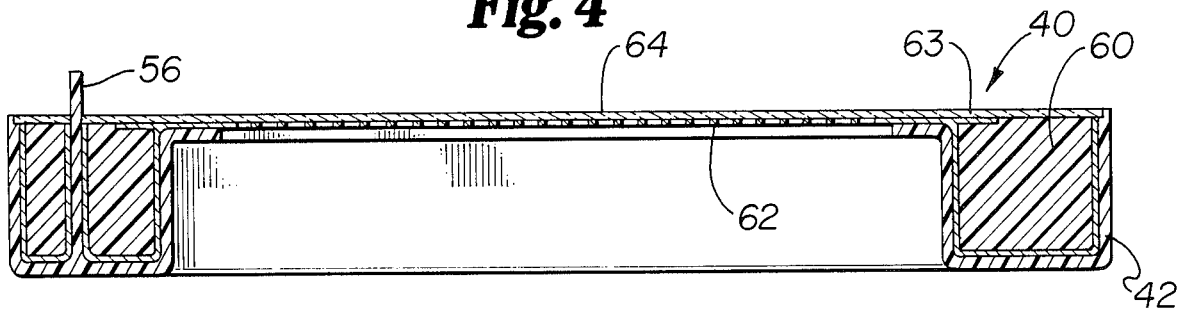
FIG. 4 shows a section view taken along line 4—4' of the frame of FIG. 2 in a completed assembly of this invention.
Figure 3:
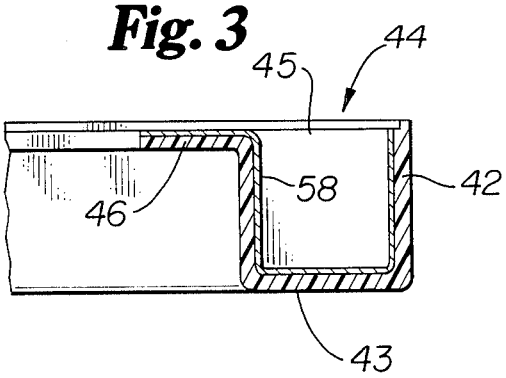
FIG. 3 shows a cross section of the frame of FIG. 2 taken along line 3-13 3'.
Figure 2:
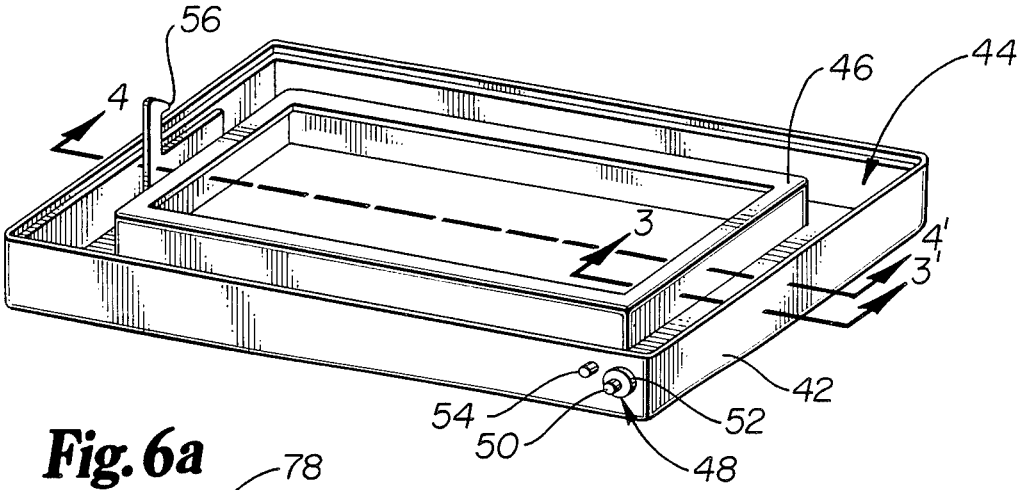
FIG. 2 shows the frame of the microwave oven door of the present invention.
Figure 6A:
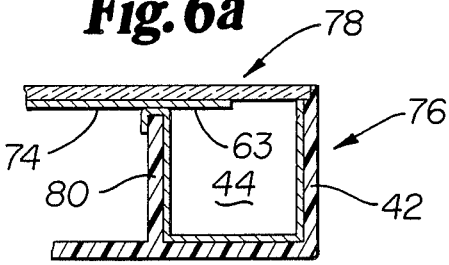
FIG. 6*a* discloses an alternative embodiment without a central viewing window.
Figure 6E:
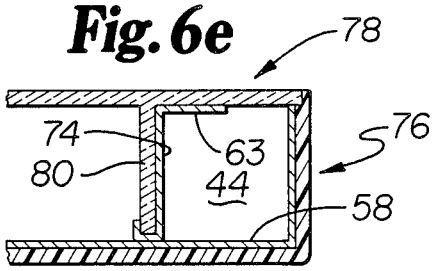
FIG. 6*e* shows a still further alternative embodiment without a central viewing window.
Figure 6B:
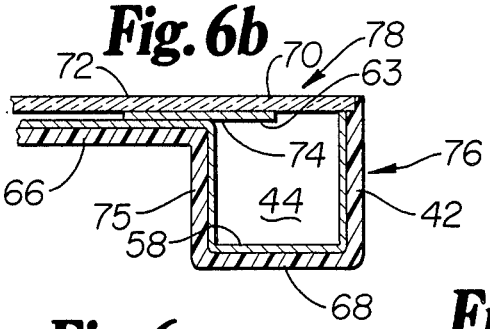
FIG. 6*b* shows a further alternative embodiment without a central viewing window.
Figure 6F:
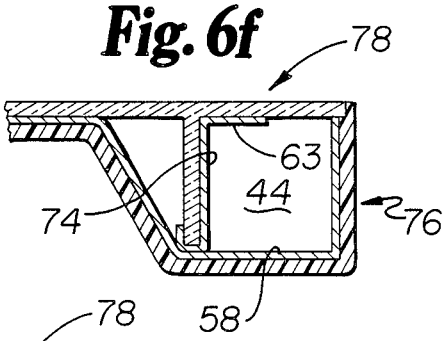
FIG. 6*f* shows a still further alternative embodiment without a central viewing window.
Figure 6C:
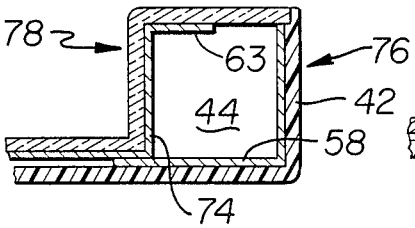
FIG. 6*c* shows a still further alternative embodiment without a central viewing window.
Figure 6G:
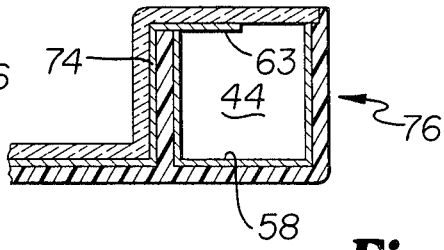
FIG. 6*g* shows a still further alternative embodiment without a central viewing window.
Figure 6D:
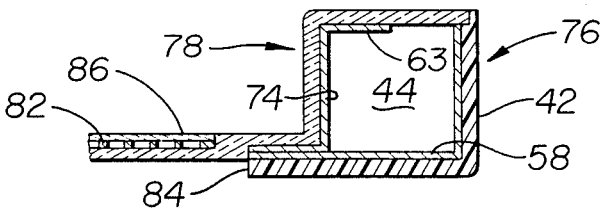
FIG. 6*d* shows a still further alternative embodiment with a central viewing window.
Figure 6H:
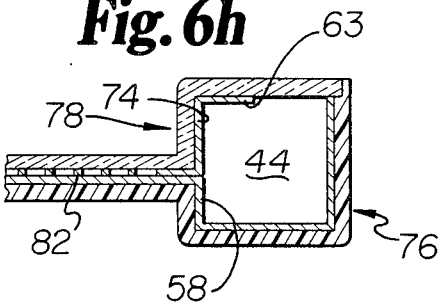
FIG. 6*h* shows a still further alternative embodiment with a central viewing window.

Referring now to FIGS. 2 through 4, the various parts of one embodiment of a microwave oven door structure 40 of this invention may be seen. Referring more particularly to FIG. 2, a frame 42 formed of a plastic material has a channel cross-section 44 formed therein. A flange 46 is formed at the interior of frame 42. Hinge means 48 may be integrally formed on frame 42. The hinge means may be made of a hinge pin 50 and a bearing surface 52. A stop pin 54 or other surface to limit door opening movement may also be integrally molded in frame 42. Alternatively, a "living hinge" may be formed by providing a relatively flexible plastic flange along one edge of frame 42 for attachment to the oven body.

A door securing means such as a latch hook or bayonet 56 may also be integrally molded in frame 42.

It has been found that a polycarbonate plastic such as that sold as Lexan TM Grade 940 by General Electric or an ABS plastic such as the KJW grade material offered by Borg-Warner, may be used for frame 42. Alternatively, various plastics may be utilized for varying properties such as flexibility or rigidity, wear resistance, and coating compatibility in molding a unitary door frame with or without integral hinge and latch functions for microwave oven duty.

Referring now more particularly to FIG. 3, the interior surface 43 of channel 44 may be provided with a microwave impermeable coating 58. It has been found that a metallic coating on frame 42 provides the necessary microwave containment. This coating may utilize the series 4700 tie coat (bond coat) and the O2Z arc spray zinc from TAFA Incorporated, Dow Road, Bow, N.H. 03301-1157. Alternatively, a copper or nickel arc sprayed coating or another microwave impermeable coating, such as metallic paint or conductive ink, may be used.

A rigid core 60 may be provided to channel 44 by a preformed or formed-in-place compressed styrofoam or other suitable material permeable to microwaves. Core 60 may be simply pressed into place or may be adhered within channel 44 by means of a suitable adhesive, and serves as a support for layers 62 and 64.

A microwave impermeable viewing window is provided by layer 62 which may be formed of a thin metallic sheet, or may be formed by an optically transparent plastic layer processed to prevent the passage of microwave energy. Such processing may include filling the plastic layer with microwave blocking material, arc spray coating, or silk screening a metallic paint or ink on such layer, for example.

Layer 62 has a projection or overhang 63 extending around the periphery of layer 62 and projecting partially across the mouth 45 of channel 44. Preferably, projection 63 extends a distance D across mouth 45 in accord with the relationship D=0.155L where L is the microwave wavelength at the operating frequency of the oven. If the oven is operated at 2450 MHz, L=4.81" and D=0.75" respectively. These are free space dimensions and it is to be understood that other dimensions will be applicable in media other than free space. Although not critical, a depth and width of channel 44 of 0.5" and 1", respectively, provide satisfactory operation.

A decorative plastic layer 64 may be applied to one or both sides of window layer 62, as necessary, to block egress of vapors from the oven interior and to provide an aesthetically pleasing and easily cleanable surface. Layers 62 and 64 may be adhered to the frame 42 and core 60 respectively by suitable adhesives. Alternatively, other fastening means such as hot or cold staking, plastic welding or bonding techniques or other fasteners may be utilized to secure this assembly together.

The projection or overhang 63 of layer 62 (which is microwave impermeable) cooperates with the inner dimensions of channel 44 and the front face plate of a microwave oven (not shown but which is to be understood to be adjacent and parallel to overhang 63) to form a choke structure in a manner well known to prevent the egress of microwave energy from between the periphery of the door and the front of a microwave oven to which it is attached.

The projection of bayonet 56 beyond layer 64 may be masked during the coating process to avoid having coating 58 visible to a user of the microwave oven, if desired.

An alternative structure for frame 42 is to form frame 42 with a plastic material carrying a filler of microwave blocking material such as carbon.

A still further embodiment is to form frame 42 of plastic with a metallic particulate filler material to provide the microwave blocking function.

Figure 5:
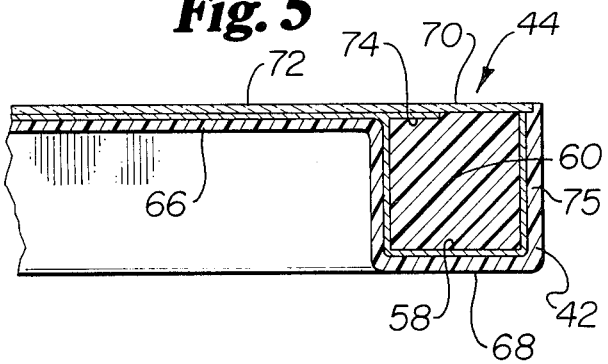
FIG. 5 shows a section view of an alternative embodiment without a viewing window.

If it is not desired to have a viewing window, an alternative embodiment as shown in FIG. 5 may be utilized. In this embodiment, frame 42 has a continuous section 66 which fills the region circumscribed by frame 42 and which replaces flange 46. In this embodiment, a microwave impermeable layer 58 extends over the interior sides and bottom of channel cross-section 44 of an outer member 75. Frame 42 may contain a decorative outer surface 68. An inner member 70 perferably also carries a microwave impermeable layer 74. Layer 74 may extend across the entire region corresponding to continuous section 66 or may be limited to a border sufficient to make contact with layer 58 on the interior of channel cross-section 44 at one side thereof.

Referring now more particularly to FIGS. 6A–6H, various additional embodiments are shown. In each of these embodiments the microwave impermeable layers 58, 74 are sandwiched between a first member 76 and a second member 78. A plastic rib 80 is providing one side of channel cross-section 44 is perferably formed on one of members 76 or 78. As may be seen, the layers or coatings 58, 74 may be selectively applied to members 76, 78 so as to form the interior surface 43 of channel cross-section 44 into a continuous microwave impermeable surface when members 76, 78 are joined together, while at the same time joining that microwave impermeable surface to projection 63 which is also microwave impermeable, to form a microwave energy door seal.

When microwave impermeable coatings are utilized in these embodiments, it is desirable to sandwich the microwave impermeable coatings between outer plastic layers to protect the coatings from contact by the user of the microwave oven which could otherwise result in impairment of the microwave impermeability of such coatings.

If it is desired to provide a viewing window in one of these embodiments, one or both of members of 76, 78 may be formed of optically transparent plastic with a perforated pattern 82 providing optical transmissivity through the microwave impermeable coating 74. It is necessary that only one of members 76, 78 be made optically transparent, if the other of those members is truncated as at edge 84; preferably a plastic film or layer 86 is then utilized to provide cleanability and protection for the perforated pattern 82.

The invention is not to be taken as limited to all of the details thereof as modifications and variations thereof may be made without departing from the spirit or scope of the invention.

What is claimed is:

1. A microwave oven door structure comprising:

a unitary frame circumscribing a central viewing aperture and formed of a plastic material having a channel cross-section adapted to face a microwave oven cavity opening;

a microwave-impermeable viewing window positioned across the central viewing aperture secured to said frame to permit visual inspection of the interior of a microwave oven cavity; and a hinge means formed as a single piece with said frame for pivotally connecting one side of the frame to a microwave oven;

wherein the frame channel is provided with a microwave impermeable coating.

2. The structure of claim 1 wherein the microwave impermeable coating is formed of a metallic material.

3. The structure of claim 1 wherein the microwave impermeable coating is formed of an arc sprayed metallizing zinc.

4. The structure of claim 1 wherein the microwave impermeable coating is formed of an arc sprayed metallizing copper.

5. The structure of claim 1 wherein the microwave impermeable coating is formed of an arc sprayed metallizing nickle.

6. The structure of claim 1 wherein the viewing window comprises a relatively thin perforated metal screen.

7. The structure of claim 6 further comprising a microwave-permeable, relatively thin plastic layer adjacent and secured to the metal screen.

8. The structure of claim 1 wherein the frame further comprises a flange circumscribing the central viewing aperture to support the viewing window.

9. The structure of claim 1 wherein the periphery of the viewing window forms a microwave impermeable projection which extends partially across the frame channel cross-section.

10. The structure of claim 9 further comprising a microwave-permeable plastic member contained within the frame channel to provide mechanical support to the periphery of the viewing window.

11. The structure of claim 1 wherein the hinge means comprises a pair of hinge pins located on a common axis.

12. The structure of claim 1 wherein the hinge means comprises a relatively flexible flange along the exterior of the one side of the frame.

13. The structure of claim 1 further comprising a door securing means formed as a single piece with said frame.

14. A microwave oven door structure comprising:

a unitary frame circumscribing a central viewing aperture and formed of a plastic material having a channel cross-section adapted to face a microwave oven cavity opening;

a microwave-impermeable viewing window positioned across and secured to the frame adjacent said central viewing aperture;

a door securing means formed as a part of said frame adapted for closely coupling another side of the frame to a microwave oven to align the door to an adjacent front surface of the microwave oven when the door is closed;

wherein the plastic material of the frame is filled with a microwave blocking material sufficient to prevent egress of substantial amounts of microwave energy from the microwave oven.

15. The structure of claim 14 wherein the microwave blocking material is a metallic material.

16. The structure of claim 14 wherein the microwave blocking material is a microwave absorptive material.

17. The structure of claim 14 further comprising a hinge means formed as a single piece with said frame.

18. A microwave oven door energy seal comprising:

(a) a first member formed of plastic material and having a peripheral L-shaped border region having a first microwave impermeable layer forming the bottom and a first side of a channel cross-section of a microwave oven door energy seal;

(b) a second member formed of plastic material and having:

(i) a peripheral planar surface adapted to be parallel to a front surface of a microwave oven, and (ii) a second microwave impermeable layer extending partially across said peripheral planar surface to form a microwave impermeable projection for said microwave oven door energy seal;

wherein a second side of said channel cross-section is formed of a plastic rib having a third microwave impermeable layer and formed integral with one of said first and second members substantially parallel to the first side of said channel cross-section such that said first and second sides are each joined to the bottom of said channel cross-section and said projection is joined to said second side in a continuous surface impermeable to microwave energy.

19. The door energy seal of claim 18 wherein said microwave impermeable layers comprise, coatings on interior surfaces of said first and second members such that physical contact with said coatings is prevented when said first and second members are assembled together.

20. The door energy seal of claim 18 wherein the microwave impermeable layer is formed of an metallic material.

21. The door energy seal of claim 18 wherein the microwave impermeable layer is formed of an arc sprayed metallizing zinc.

22. The door energy seal of claim 18 wherein the microwave impermeable layer is formed of an arc sprayed metallizing copper.

23. The door energy seal of claim 18 wherein the microwave impermeable layer is formed of an arc sprayed metallizing nickel.

24. The door energy seal of claim 18 wherein at least one of said microwave impermeable layers comprises a microwave blocking material filler sufficient to prevent egress of substantial amounts of microwave energy from the microwave oven.

25. The door energy seal of claim 24 wherein the microwave blocking material is metallic.

26. The door energy seal of claim 24 wherein the microwave blocking material is a microwave absorptive material.

* * * * *